United States Patent [19]

Kondos et al.

[11] 3,971,310

[45] July 27, 1976

[54] PRESS FOR SQUEEZING AGRICULTURAL PRODUCTS

[76] Inventors: George C. Kondos, Patission Street, 153; Dimitrios I. Angelou, Sevastoupoleos Street, 47–49, both of Athens, Greece

[22] Filed: Feb. 18, 1975

[21] Appl. No.: 550,746

[30] Foreign Application Priority Data

Feb. 16, 1974 Greece ..... 49623

[52] U.S. Cl. ..... 100/118; 100/152

[51] Int. Cl.[2] ..... B30B 9/24

[58] Field of Search ..... 100/118–120, 100/151–154

[56] References Cited

UNITED STATES PATENTS

| | | | |
|---|---|---|---|
| 243,369 | 6/1881 | Gubbins | 100/152 |
| 1,049,614 | 1/1913 | Sigler et al. | 100/120 X |
| 1,778,342 | 10/1930 | Thompson | 100/154 X |
| 1,908,807 | 5/1933 | Ashley | 100/118 |
| 3,106,152 | 10/1963 | Coffelt | 100/152 X |

FOREIGN PATENTS OR APPLICATIONS

| | | | |
|---|---|---|---|
| 414,515 | 6/1910 | France | 100/152 |
| 572,324 | 2/1924 | France | 100/152 |

*Primary Examiner*—Peter Feldman
*Attorney, Agent, or Firm*—Robert T. Tobin

[57] ABSTRACT

The press is made up to operate continuously to squeeze agricultural products such as grapes. The press is formed of a pair of driven endless belts which are disposed to define a converging passageway. The belts are also mounted in spring means to adjust to a build-up in pressure in the passageway and to permit an increase in the passageway at the exit end to accommodate an increased flow.

13 Claims, 11 Drawing Figures

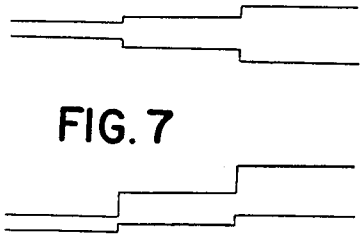
FIG. 7
FIG. 8
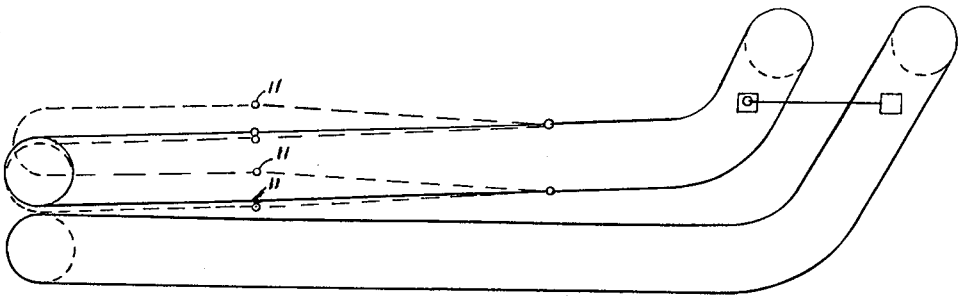
FIG. 5
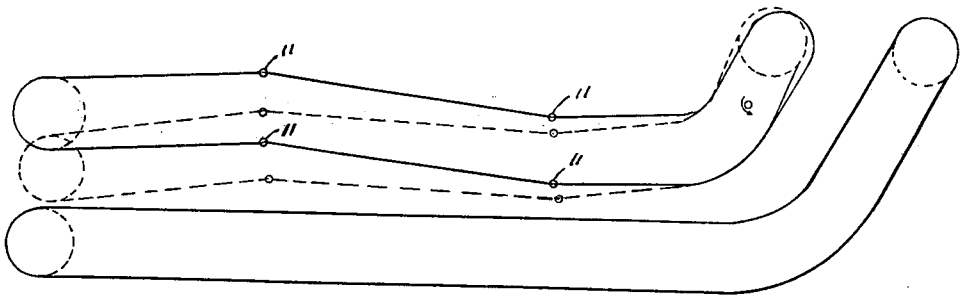
FIG. 6

6
5
1
3
2
2
2
2
6

PRESS FOR SQUEEZING AGRICULTURAL PRODUCTS

This invention relates to a press for squeezing agricultural products such as grapes, oleaginous fruits and seeds, extracted pieces of sugar beets, fruits and agricultural by-products.

As is known, during the middle ages, use was made of presses of the piston-type to complete the squeezing process of grapes that was done by foot inside cisterns of stone. Generally, this constituted the beginning of the mechanization of the squeezing of grapes for the production of wine.

For the recent past, the presses used for the squeezing of the grapes for wine production have been of a non-continuously operating type which use a piston or a continuously operating type which use an endless screw. Both these types of presses usually require a cutting machine to cut the grapes prior to squeezing or, perhaps, to take away curls of the grapes.

In the above types of presses, the final pressures that usually are developed are great.

It is known that great pressures applied for the squeezing of the grapes, as well as the use of any cutting machine before the squeezing, contribute to the taking-up by the must of many undesirable tanning, albuminous, greasy, pectinic and other not sugary substances that have a bad influence upon the quality of the final wine. Also, it is known that any prolongation of contact between the pulp under treatment and the surrounding air, no matter if this is due to the additional use of machines, such as a cutting machine, or to a longer stay inside the squeezing machine, is a bad influence upon the value of the must produced. Also, any prolongation of the treatment of the pulp results in an increase of the quality of the undesirable non-sugary constituents taken up by the must.

As is known, the presses which use an endless screw cannot obtain an unhindered and continuous operation in many cases because of the interposition of a pre-pressing machine. Also, any intense aeration of the must due to the high speed of a centrifugal machine normally used to break up and take away the grape curls, must be considered as highly injurious to and as lowering the value of the must produced.

Although the screw-effect of continuous presses is highly desirable in cases where a high degree of squeezing is sought and where there is no interest in the mechanical injuries done to the squeezed mass by the shear and the torsion, especially upon grapes, this effect has an unfavorable influence upon the value of the must. This is because the must takes up the previously mentioned non-sugary substances from the skins of berries, from the curls and from the grape-seeds.

Accordingly, it is an object of the invention to provide a press for grapes which does not require a cutting machine for pre-cutting the grapes or for taking away curls.

It is another object of the invention to avoid the imposition of any comparatively serious mechanical injuries on the squeezed mass.

It is another object of the invention to develop a press for a fully continuous operation of a simple form.

Briefly, the invention provides a press which in its simplest form comprises a pair of perforated endless belt means disposed in opposed relation, guide means mounting the belt means to define a converging passageway from an entrance end to an exit end, and means for driving the belt means in opposite directions. For example, one belt means rotates clockwise and the other in the opposite direction. The press also includes two pairs of parallel drums at each end of the passageway with each of the two endless belt means extending between the two drums. The passageway formed between the belt means converges on an angle which fluctuates from 1° to 30°. Preferably, the angle should fluctuate from 3° to 20°. Still more preferably the angle should be between 5°to 10°.

The press also includes a pair of perforated vertical side walls, each on an opposite side of the passageway, and spring means secured to the guide means for resiliently mounting the belt means relative to each other to permit an outward vertical adjustment of at least one of the belt means to the other in response to excessive pressure within the passageway.

The endless belt means may use endless belts or may be made in the form of a caterpillar consisting of perforated plates of proper size bound together by a proper system of joints. In the following description for the sake of simplicity the terms "belts" and "caterpillars" are used in the spirit of the invention with the same meaning. The belts may be made of any suitable material such as steel of any kind, wood, synthetic material or any combination of them. These materials can also be coated with a special epoxy-resin. Also, the belts may be made of an elastic material with a proper reinforcement or a synthetic material either reinforced or not reinforced.

The surface of the endless belts or of the caterpillars can be formed with standards, like those on elastic tires, of smaller or greater depth in order to assist the slowly moving belts in the carrying of the grapes being conveyed for squeezing.

In another embodiment, the endless belts can be made of very strong lattice work (trusses) of stainless steel or out of special synthetic yarns stretched upon a proper support construction. The weaving of the lattice work is of the usual form as is known in sieves of the different types. It is possible to use one or more latticeworks placed one upon the other for the formation of each belt. The lattice work can be held inside frames of proper strength possibly carrying a cross-shaped reinforcement.

In another embodiment, instead of rolling caterpillers, use can be made of rolling staircase type of endless belt means. In this case, the centroids of the stairs of each staircase trace out a curve similar to that of the above described belts. The main advantage of the above form is that any possibility of escape of a broken plate of cake that is under squeeze is avoided.

In another embodiment, the form of the staircase can be more complex. In this case, the centroids of the stairs of each staircase trace out broken lines.

In general, the motion can be transmitted to the endless belts from the drums according to the methods used for the motion of vehicles carrying caterpillars or for the motion of rolling staircases and from a means such as an elastic motor through a bear box.

The converging endless belts that are under the above-mentioned angles, roll upon drums that are absolutely parallel to one another. In other words, the press can be considered as a press constructed of two converging belts which move between two vertical side walls to convey grapes for squeezing and to guide the grapes under a progressively increasing pressure towards the end of the press where the greatest pressure is exerted and where the squeezed cake is taken out.

It must be understood that this endless belt is perforated throughout all of its length in order to secure the free passage of the produced juices. Also, the side walls of the press are perforated. The produced must is collected, conforming its quality, in bowls that are placed under the press. These bowls are constructed with the usual steel plates coated by an epoxy-resin.

In another embodiment, the holes in the belts and in the side walls for the passage of the juice have the shape of a truncated cone with the base turned toward the side of exit of the must. The holes have proper dimensions from 1 up to 10 millimeters (mm). Holes of truncated ellipsoid by revolution form or different truncated pyramid form are also possible.

In another embodiment, the holes are of a cylindrical ellipsoid by revolution form, of a rectangular parallelepiped prism with triangular, quadrangular or of a polygonal form of base, or of any combination of the above geometrical forms. Also, the holes can have an elongated form or the form of a groove. In general, the holes can have any proper form used in the sieves of presses, of the centrifuges for draining, filtration, etc.

As it is known, during the squeezing of grapes in a classicla non-continuous press (i.e. discontinuous) whenever a pressure is created above a certain limit and above the ability of the juice to pass through the mass of the squeezed grapes, then the pressing is automatically stopped until a chance is found by the juice to pass through and re-establish the lower pressure, when the squeezing starts again. However, since the development of an excessive pressure will not only create the above-mentioned unfavorable influence upon the value of the juice but also an excessive resistance to the flow of the juice, there is a resultant waste of power, or an unequal distribution of pressure in the mass of the pulp with an unequal squeezing of the grapes (for example, berries can be found inside the cake which are not pressed).

In the press of the invention consideration is given to the fact that the pressing of grapes in a press of any type is not only the act of the compression of a solid body or of a mixture of solid and of fluid bodies, but also is a question of filtration under pressure analogous to that in the operation of a filter press. Of course, there is a great difference in that in the filter press the cake is not moving and in the press of the invention the cake is moving. At every point along the moving belts, the filtering medium and the mass to be filtered change behavior during filtration so that the dynamic condition of equilibrium changes with time.

These above conditions are considered of primary vlaue. The press construction thus takes into account the fact that the applied pressure (P) varies as a function of the resistance of the passing of juice (R) with time (T) $P = f(R, t)$.

The spring means for resiliently mounting the belt means may include properly calculated springs and joints to impart to the press the possibility of "feeling" an increase of pressure above a predetermined limit and to "retreat". By doing so, an excessive pressure is avoided as well as a need to stop compression. Thus, it is possible to change the inclination between the belts to cause a proper continuous change of the pressure exerted upon the grapes in relation to the conditions of variety, quality, physical conditions and the like of the grapes. The springs which are automated under a certain program and by a suitable automatic control means can be hydraulic or pneumatic or coil or with sheets. Without the above-mentioned arrangement of springs and joints, excessive pressures might otherwise be created in the continuously operating press which would lead to obstructions that would require a temporary interruption of the operation for evacuation or to damage of the press.

Another possibility of regulating the exerted pressures in connection with the time and of the resistance of the filtration is to change the speed of the belts or of the caterpillars. This change is succeeded by a proper arrangement of motion transmission.

Although the present invention refers to a press of continuous operation for the pressing of grapes in which the final highest pressures are substantially lower than those predominating in the previously known presses, the yield in percent of must from the compressed grapes is not lower of that of the previous presses. This is because the squeezed grapes which move continuously towards the outermost crevice of final extrusion form a cake that, in proportion with its own weight, not only presents a surface of filtration (i.e. the surface of the juice passage through the squeezed grapes that form the means of filtration) many times greater but also an exit flow path for the juice in the squeezed mass many times less than in the same mass of compressed cake of the previously known presses of the endless screw type or of the piston type. In addition, because of the applied lower pressures the filter cake within the press presents less obstructions and is more porous. This permits better filtrations and better pressings. Of course, in case of need, it is possible to complete the filtration by connection of a filter, for example, a filter-press or of a filter with kieselguhr after the press.

In an improved embodiment of the invention, the length of the endless belts can be increased for about up to 30% of the total length of the press but on a parallel direction. This extension is made in order to avoid the application of pressures greater than the highest forseen and to enhance the filtration of the must through the cake of the already squeezed grapes.

There is no limitation about the inclination of the press of the present invention with respect with the horizon. The press can be placed in a plant with an inclination downwards or upwards or without inclination parallel to the horizon. The selection of the proper inclination should be selected in accordance with the rationalistic operation of the unit.

In a preferred embodiment of the invention, it is possible to move one to ten or still more strips of lattice work made from a synthetic material or from steel between the two rolling belts under the influence of the grapes. These strips serve to hold the cake together and to create additional passages for the escape of the produced juice. The width of the strips is determined in dependence upon the form of the lattice works. The use of the strips of lattice work also facilitates the disintegration of the compressed cake upon existing from the press. After disintegration, the strips pass through a suitable arrangement for the removal of any remaining grape husk and for restretching.

These and other objects and advantages of the invention will become more apparent from the following detailed description and appended claims taken in conjunction with the accompanying drawings in which:

FIG. 5 illustrates a schematic side view of the press during an initial phase of operation;

FIG. 6 illustrates a schematic side view of the press during the occurrence of an increased pressure in a squeezed mass;

Figure 9:
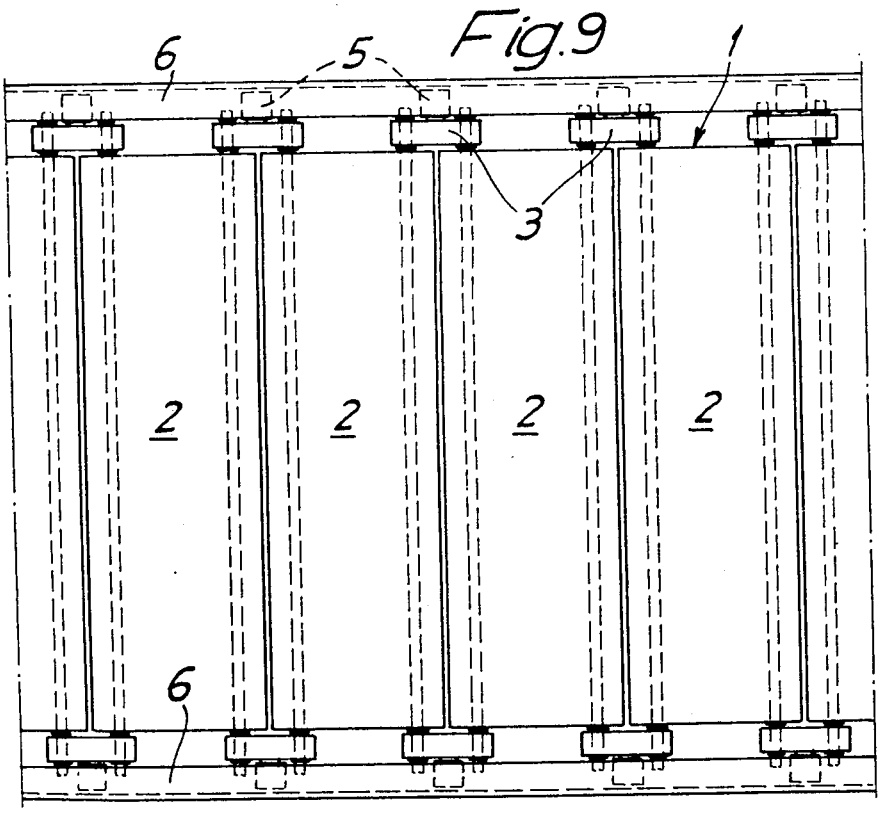
Figure 11:
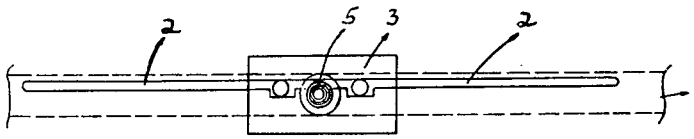
Figure 10:
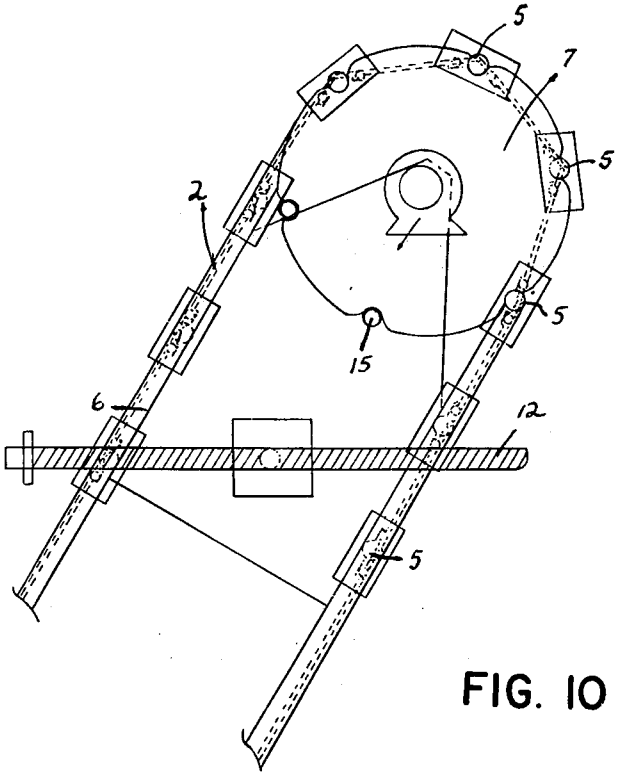

FIG. 7 schematically illustrates a modified form of a passageway defined by a press of the invention;

FIG. 8 schematically illustrates a further modified form of a passageway according to the invention;

FIG. 9 illustrates a partial view of an endless belt according to the invention;

FIG. 10 illustrates an enlarged view of one of the endless belts at the entrance end of the press; and FIG. 11 illustrates a detail of a joint between two plates of an endless belt of the press.

In all the Figures, the same reference characters indicate the same parts. Also, as declared in the above description and in the following, the terms "endless belt" and "caterpillar" are used indiscriminately, unless otherwise declared.

Figure 1:
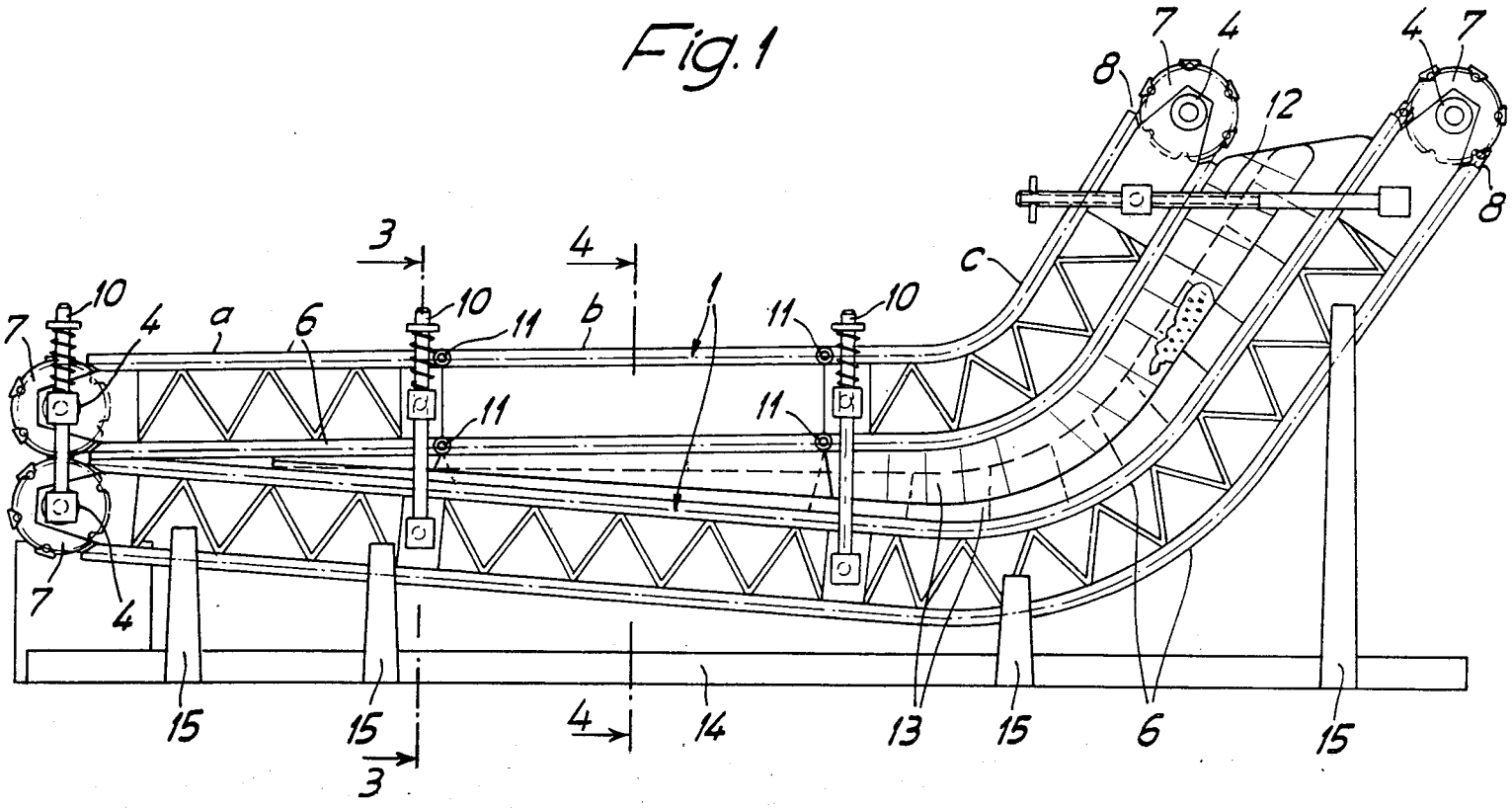
FIG. 1 illustrates a side view of a press according to the invention.
Figure 2:
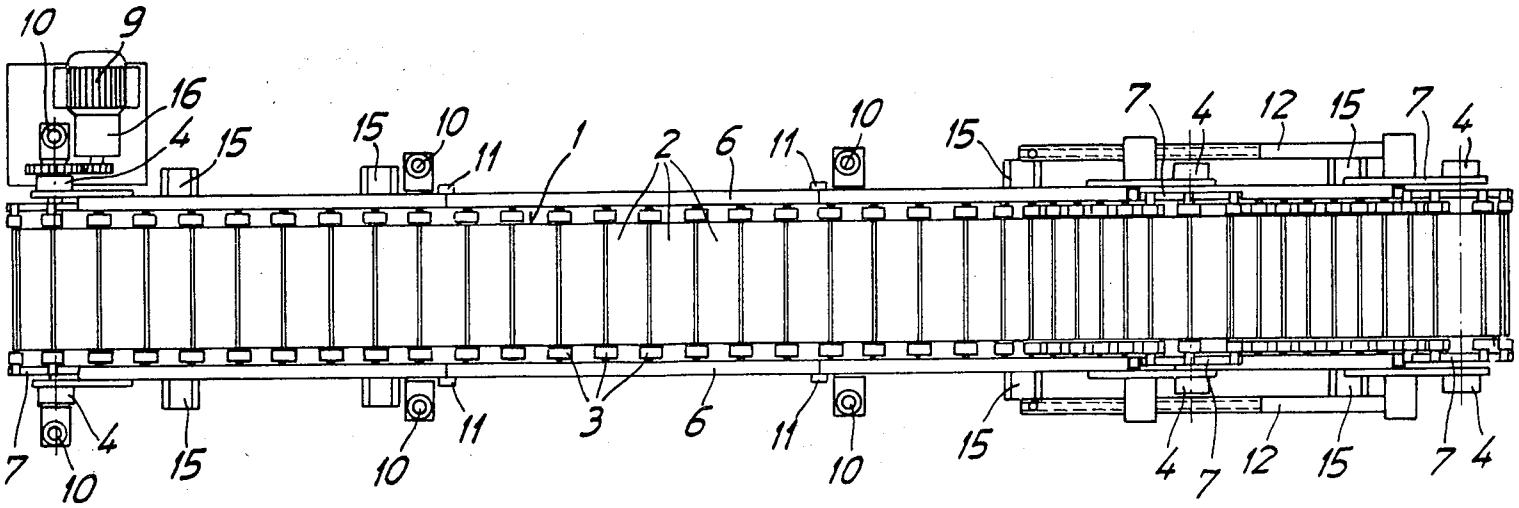
FIG. 2 illustrates a top view of the press of FIG. 1.

Referring to FIG. 1, the press has a pair of enless belt means such as caterpillars 1 which rotate in opposite directions and define a converging passageway in which a product such as grapes are squeezed. Each caterpillar 1 consists of many plates 2 which are connected together by joints 3 (FIGS. 9 and 11) and are perforated in order to permit the passage of juice squeezed from the grapes.

As shown in FIG. 9, each joint 3 terminates at each end in a bearing 5. Each bearing 5, in turn, moves in a guide means which is formed of a series of straight and curved slides or rails 6 of channel-shape or of any other analogous shape. These guide rails 6 end tangentially on drums 7 which are rotatably mounted in pairs at the ends of the caterpillars 1 (see FIG. 1) and about which the caterpillars 1 pass.

As shown in FIG. 10, each drum 7 has notches to receive the bearings 5 and the points 8 where the bearings 5 leave the rails 6 in order to advance the caterpillar 1. Each drum 7 is rotatably mounted in a bearing 4 which is fixedly mounted relative to the rails 6.

The lower caterpillar 1 is driven by motor 9 via a gear box 16 in a counterclockwise direction as viewed and moves within the rails 6 of the guide means associated therewith. The path of the lower caterpillar 1 is fixed. The upper caterpillar 1 which is driven off the gear box 16 moves between a series of non-continuous rails 6 which are connected by joints 11 at eight points. In this way, the upper rails 6 and the upper caterpillar are separated into three articulated sections *a*, *b* and *c*. The motor 9 and gear box 16 may be used to drive the two caterpillars at different linear speeds.

In the regions *a* and *b*, as well as in all the length of the lower caterpillar the guide rails 6 are supported by a plurality of support structures in the form of light weight lattice work. In the region *b*, the guide rails 6 are reinforced with a suitable rib. In this way, and with the help of a spring means consisting of three pairs of hydraulic, pneumatic or mechanical springs 10 and a pair of screws 12, all these sections *a*, *b* and *c* of the upper caterpillar change position with respect to the lower caterpillar in response to the resistance presented by the material under squeeze. It is to be noticed that the guides of all the springs 10 are connected with the lattice works of the press by joints, while the pair of screws 12 is fixedly connected with the lattice work of the lower caterpillar and via a joint with the lattice work of the upper caterpillar. Further, each spring 10 is automated, e.g. hydraulically activated, by a control means (not shown) so as to effect an adjustment between the two caterpillars.

FIGS. 5 and 6 illustrate the shape of the path that is traced by the upper caterpillar for various extreme positions during use.

Figure 4:
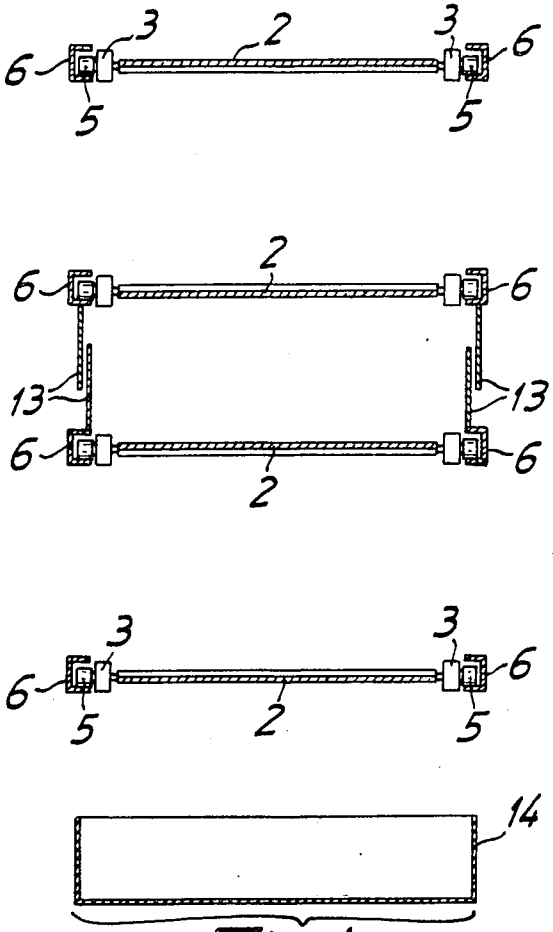
FIG. 4 illustrates a view taken on line 4—4 of FIG. 1.
Figure 3:
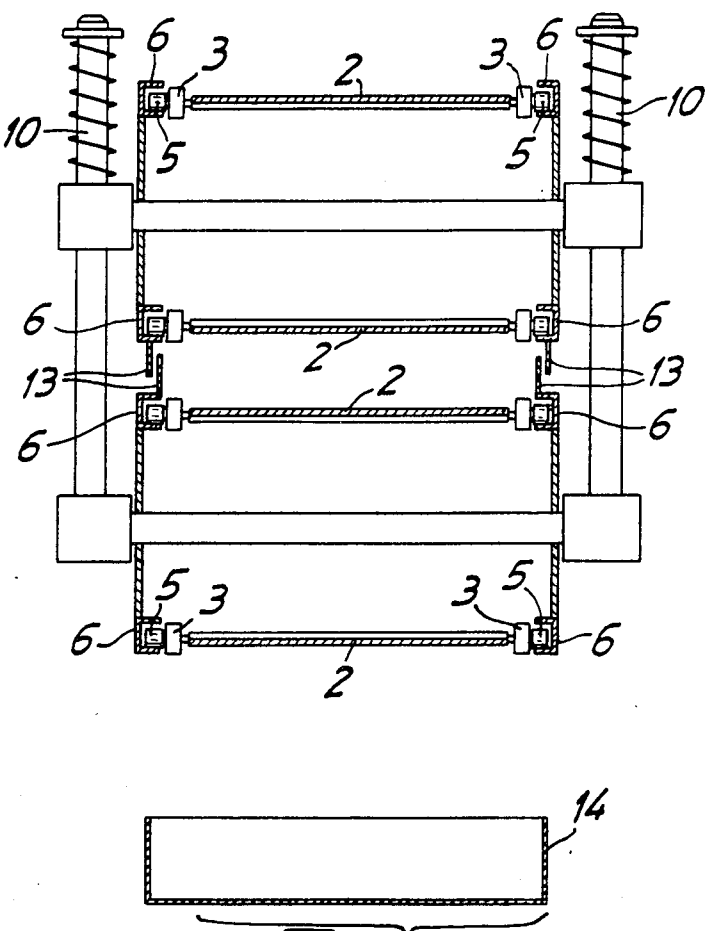
FIG. 3 illustrates a view taken on line 3—3 of FIG. 1.

Referring to FIG. 4, the compression space or passageway between the upper run of the lower caterpillar and the lower run of the upper caterpillar is confined by vertical side walls 13. These side walls 13 are perforated like the caterpillars in order to permit the flow of juice through them. Each sidewall consists of two vertical disposed half portions that overlap a sufficient amount so to be able to change height by sliding relative to each other with the upper portion following the movements of the rails 6 of the upper caterpillar and with the lower one staying fixed and bound with the rail 6 of the lower caterpillar.

In order to be able to follow the movements of the upper rail the upper portion of each of the side walls 13 is divided in three pieces a, b and c that are interconnected elastically by a strip of elastic sheet (not shown) of a width so as to permit transposition of the pieces with respect to one another. The pieces may alternatively be connected in pairs and covered by one another. These perforated pieces have vertical tie-ribs on their slide sides in order to prevent contact with the lower portion which might otherwise block the holes of the parts that are covered.

The press is supported by a suitable support means upon the ground. For example, the support includes feet 15 which connect to the lattice works (i.e. trusses) of the slides of the lower caterpillar. Each caterpillar can be supported by two or by more lattice works (trusses) which are placed at proper distances and carry the slides 6. Collecting bowls 14 for the produced juice are placed on the ground under the lower run of the lower caterpillar.

Referring to FIG. 5, should a smooth flow of product such as grapes be conveyed through the press, the trace of the caterpillars follows a smooth conveying path. However, should the resistance of the squeezed mass be increased, due to the quality or condition of the grapes, the upper caterpillar moves upwardly as indicated in dotted line. Of course, if less product is fed into the press, the upper caterpillars tend to take up the position shown in solid line.

Referring to FIG. 6, should a localized increase in resistance occur, the upper caterpillar can take up any position within the range permitted by its construction such as those illustrated.

The caterpillars (i.e. endless belts) 1 of the press may be constructed and guided to define a passageway which converges in a stepwise manner with each of the opposed runs stepped toward the other in symmetric relation (FIG. 7) or with each of the opposed runs stepped away from each other in disproportionate relation (FIG. 8).

The present invention thus provides a press of continuous operation type for the squeezing mainly of grapes, and also of already extracted pieces of sugar-beets, of oleaginuous fruits and seeds of any kind, of other fruits and of other different agricultural products and by-products.

Further, the press allows an adjustment in the relative motion between the moving belts to allow for variations in the quality of the product which may be used for wine or for some other application.

The press provided by the invention may be used alone without the use of a cutting machine for the grapes or for taking away the curls and without the use of a pre-press. Nevertheless, the press can operate in combination with a cutting machine and/or pre-press.

In the press provided by the invention, the squeezed mass does not suffer comparatively serious mechanical injuries because the belts are moving with the same speed and in the same direction. This is highly desirable in the case of grapes since the non-sugary constituents from the skins of berries, the curls and the grape-seeds are not extracted into the juice.

It is to be noted that the press may also be provided with pressure control means and switches for automatically activating the control means for the springs 10 to move the endless belt means relative to each other to increase the size of the passageway. As noted above, an excess pressure within the passageway is avoided along with the need to stop the squeezing operation in order to correct the problem causing the increased pressure.

What is claimed is:

1. A press for squeezing agricultural products comprising a pair of perforated endless belt means disposed in opposed relation to each other;

guide means mounting said pair of belt means therein to define a converging passageway between said pair of belt means from an entrance end to an exit end, said guide means including a series of guide rails guiding each endless belt means, said guide rails being separated into a plurality of articulated sections;

means for driving said pair of belt means in opposite directions;

a pair of perforated vertical side walls between said pair of endless belt means, each said side wall being disposed on an opposite side of said passageway; and spring means secured to said guide means for resiliently mounting said guide rail sections and belt means therein relative to each other to permit an outward vertical adjustment of said guide rail sections and said belt means therein to the other in response to excess pressure within said passageway.

2. A press as set forth in claim 1 which further comprises a plurality of support structures secured to said guide means to support said exit end of said belt means at an elevated level.

3. A press as set forth in claim 1 which further includes at least one pair of screws at said entrance end of said passageway for adjusting said endless belt means relative to each other to vary the size of said passage at said entrance end.

4. A press as set forth in claim 1 wherein said passage converges at an angle of from one degree (1°) to thirty degrees (30°).

5. A press as set forth in claim 8 wherein said means for driving drives said belt means at different linear speeds.

6. A press as set forth in claim 1 wherein each said side wall includes an upper portion secured to one of said rails along a lower run of the upper belt means and a lower portion secured to another of said rails along an upper run of the lower belt means, said portions being disposed in overlapping relation.

7. A press as set forth in claim 1 wherein said means for driving includes at least one motor and a gear box between said motor said pair of belt means.

8. A press as set forth in claim 1 wherein each said spring means is programmed to automatically effect an adjustment between said belt means.

9. A press as set forth in claim 1 which further comprises at least one bowl below said endless belt means for collecting juice squeezed from a product in said passageway.

10. A press as set forth in claim 1 wherein said endless belt means and said side walls have perforations each of which has a greater opening on the end facing said passageway than on the exit end.

11. A press as set forth in claim 1 wherein each endless belt means includes a series of interconnected frames, each said frame including at least one lattice work of material to form perforations for the flow of juice therethrough.

12. A press as set forth in claim 1 wherein each endless belt means includes a plurality of standards for assisting the carrying of the product.

13. A press as set forth in claim 1 wherein at least one of said endless belt means is a continuous endless belt.

* * * * *